US010622725B2

(12) United States Patent
Barratt et al.

(10) Patent No.: US 10,622,725 B2
(45) Date of Patent: Apr. 14, 2020

(54) MODULAR FEED SYSTEM FOR AXIS SYMMETRIC REFLECTOR ANTENNAS

(71) Applicant: AvL Technologies, Inc., Asheville, NC (US)

(72) Inventors: Bruce Barratt, Asheville, NC (US); Keith Edenfield, Weaverville, NC (US); Ian J. Timmins, Asheville, NC (US)

(73) Assignee: AvL Technologies, Inc., Asheville, NC (US)

( * ) Notice: Subject to any disclaimer, the term of this patent is extended or adjusted under 35 U.S.C. 154(b) by 0 days.

(21) Appl. No.: 15/950,925

(22) Filed: Apr. 11, 2018

(65) Prior Publication Data

US 2018/0294543 A1 Oct. 11, 2018

Related U.S. Application Data

(60) Provisional application No. 62/484,089, filed on Apr. 11, 2017.

(51) Int. Cl.

| | |
|---|---|
| ***H01Q 1/12*** | (2006.01) |
| ***H01Q 15/16*** | (2006.01) |
| ***H01Q 1/08*** | (2006.01) |
| ***H01Q 19/12*** | (2006.01) |
| *H01Q 15/14* | (2006.01) |

(52) U.S. Cl.

CPC ..... *H01Q 15/16* (2013.01); *H01Q 1/088* (2013.01); *H01Q 1/1207* (2013.01); *H01Q 19/12* (2013.01); *H01Q 15/14* (2013.01)

(58) Field of Classification Search

CPC ..... H01Q 19/12; H01Q 1/088; H01Q 1/1207; B29C 59/02

See application file for complete search history.

(56) References Cited

U.S. PATENT DOCUMENTS

| | | | | |
|---|---|---|---|---|
| 3,483,564 | A * | 12/1969 | Glynn | H01P 1/042 343/771 |
| 6,373,449 | B1 * | 4/2002 | Bokulic | H01Q 1/288 343/840 |
| 6,507,324 | B2 * | 1/2003 | Overton | H01Q 1/088 343/840 |
| 9,225,071 | B2 * | 12/2015 | Lee | H01Q 1/1207 |

(Continued)

*Primary Examiner* — Ab Salam Alkassim, Jr.
(74) *Attorney, Agent, or Firm* — William G. Heedy; The Van Winkle Law Firm

(57) ABSTRACT

A modular feed system for axis symmetric reflector antennas includes an upper hat segment, a mid-section segment and a lower base segment, the upper hat and lower base segments being securable to respective opposing ends of the mid-section segment; wherein the length of the mid-section segment is selected in order to accommodate application of a particularly sized reflector antenna; and a mechanical mating mechanism including base slots for feed spring entry, corresponding carriage springs on the feed, and corresponding recessed spring capture locations; and wherein the carriage springs are sized and configured to pass through the corresponding base slots for feed spring entry as part of the initial mating of the feed to the base segment, and selective rotation thereof moves the corresponding carriage springs into corresponding recessed spring capture locations and causing a mechanically audible sound for indicating that the feed has locked into position.

6 Claims, 7 Drawing Sheets

(56) References Cited

U.S. PATENT DOCUMENTS

| | | | | |
|---|---|---|---|---|
| 9,472,856 | B2 * | 10/2016 | Yano | H01Q 15/16 |
| 9,698,491 | B2 * | 7/2017 | Lee | H01Q 1/125 |
| 9,812,761 | B1 * | 11/2017 | DiCicco | H01Q 1/088 |
| 9,893,398 | B2 * | 2/2018 | Taptič | H01Q 13/02 |
| 10,418,718 | B2 * | 9/2019 | Lee | H01Q 19/193 |
| 2002/0105475 | A1 * | 8/2002 | Overton | H01Q 1/088 343/878 |
| 2014/0292605 | A1 * | 10/2014 | Roberts | H01Q 13/20 343/781 CA |
| 2015/0061956 | A1 * | 3/2015 | Yano | H01Q 15/16 343/781 CA |
| 2015/0303580 | A1 * | 10/2015 | Wright | H01P 1/042 343/772 |
| 2016/0156107 | A1 * | 6/2016 | Lee | H01Q 1/24 343/840 |
| 2018/0323493 | A1 * | 11/2018 | Taptic | H01Q 1/22 |

* cited by examiner

MODULAR FEED SYSTEM FOR AXIS SYMMETRIC REFLECTOR ANTENNAS

RELATED APPLICATION

This is a U.S. non-provisional application relating to and claiming the benefit of U.S. Provisional Patent Application Ser. No. 62/484,089, filed Apr. 11, 2017.

FIELD OF THE INVENTION

This invention relates to modular feed technology for developing upper and lower sections that are common to each of the X, Ku and Ka bands, whereby a mid-section component is inserted to allow for usage in combination with dissimilarly sized reflectors while using the same upper and lower section components.

BACKGROUND OF THE INVENTION

Satellite communications generally include the use of artificial satellites to provide communication links between various points on Earth and use the high-frequency range of 1-50 GHz to transmit and receive signals. The frequency ranges, i.e., frequency bands, are identified by letters: L-, S-, C-, X-, Ku-, Ka-, and V-bands. Signals in the lower range (L-, S-, and C-bands) of the satellite frequency spectrum are transmitted with low power, and thus larger antennas are needed to receive these signals. Signals in the higher end (X-, Ku-, Ka-, and V-bands) of this spectrum have more power; therefore, dishes as small as 18 inches in diameter can receive them. Accordingly, the X-, Ku-band and Ka-band spectrum is ideal for military communications, direct-to-home (DTH) broadcasting, broadband data communications, and mobile data applications.

There exists a need for a modular feed system for axis symmetric antennas, whereby upper, middle and lower regions (collectively, the bayonet) are segmented. By using common upper and lower segments that provide feeding function across a particular band of interest, the upper and lower segments can be used across various reflector sizes by scaling the length of a middle segment.

SUMMARY OF THE INVENTION

In accordance with one form of this invention, there is provided a modular feed system for axis symmetric reflector antennas includes an upper hat segment, a mid-section segment and a lower base segment, the upper hat and lower base segments being securable to respective opposing ends of the mid-section segment; wherein the length of the mid-section segment is selected in order to accommodate application of a particularly sized reflector antenna; and a mechanical mating mechanism including at least one base slot for feed spring entry, at least one corresponding carriage spring on the feed, and at least one corresponding recessed spring capture location; and wherein the at least one carriage spring is sized and configured to pass through a corresponding one of the at least one base slots for feed spring entry as part of the initial mating of the feed to the base segment, and selective rotation thereof moves the corresponding one of the at least one carriage springs into a corresponding one of the at least one recessed spring capture locations and causing a mechanically audible sound for indicating that the feed has locked into position.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the bayonet feed structure of the present invention is shown and described herein and is generally indicated as 10.

Figure 1:
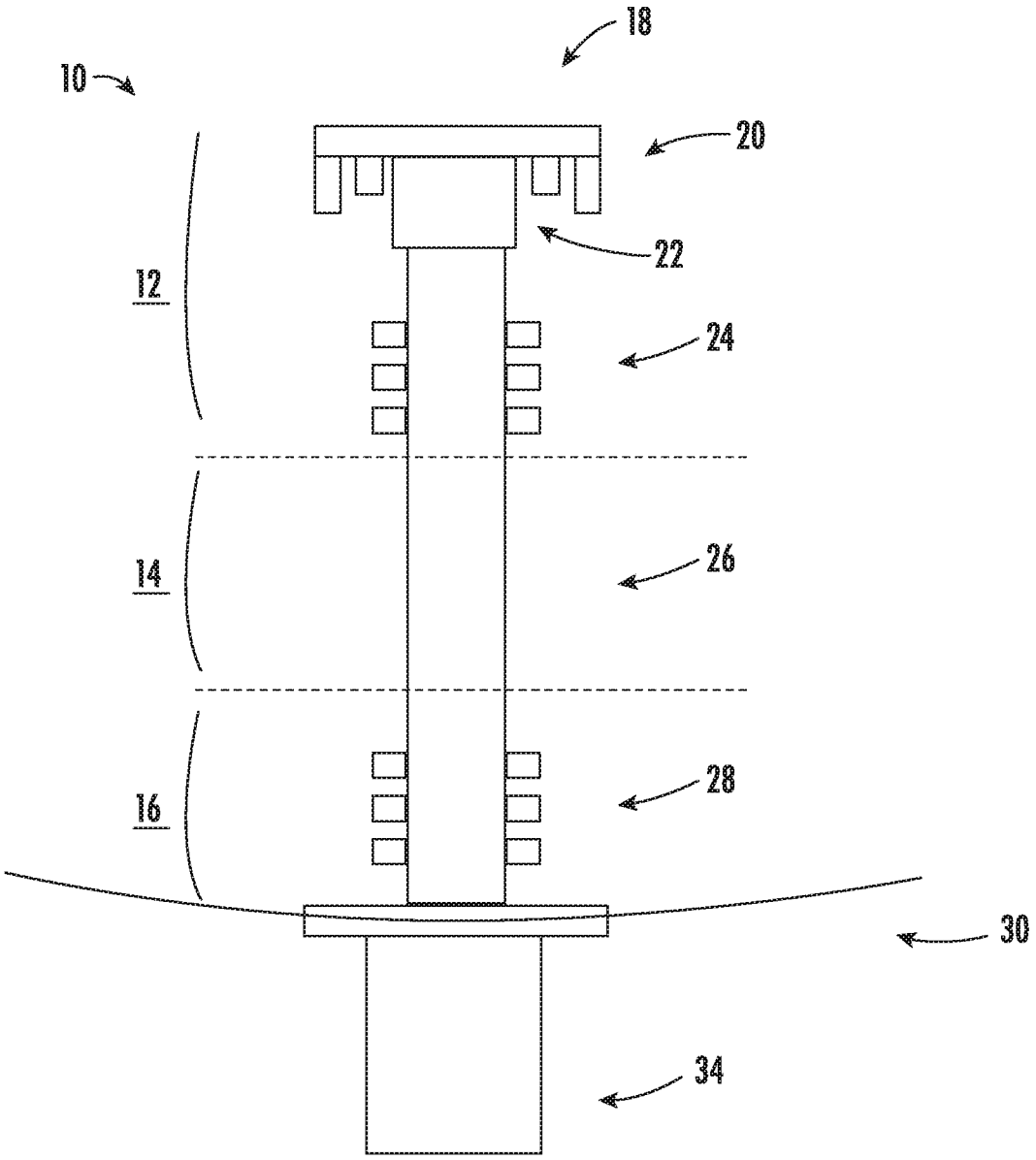
FIG. 1 is a diagram illustrating a bayonet feed structure segmented into upper hat, mid-section and lower base segments, and including a reflector.

Referring to FIG. 1, the modular feed system for axis symmetric antennas includes the following three distinct segments of the bayonet feed structure 10 an upper hat segment 12, a mid-section segment 14, and a lower base segment 16. The upper hat segment 12 includes a splash plate 18, corrugation 20, head 22, and matching rings 24. The mid-section segment 14 includes the waveguide 26. The lower base segment 16 includes matching rings 28. The reflector 30, coupler and polarizer 34 are also shown. Importantly, various embodiments of the modular feed system for axis symmetric antennas include bayonet feed structures 10 having common upper hat and lower base segments 12 and 16 being securable to mid-section segments 14 of varying length.

Still referring to FIG. 1, the bayonet feed structure 10 is segmented into the three distinct segments in order to allow for easy installation of different combinations of the components on various sized reflectors 30 across different frequency bands. In the field of RF and microwave, it is common for devices to be physically sized on the order of several wavelengths of the carrier frequency, and the segmentation of the bayonet reflects this trend. That is, the distance below the head 22 is typically on the order of a few wavelengths. In order to create modularity, the upper hat and lower base segments 12 and 16 remain a fixed form factor, while the mid-section segment 14 is designed such that it can be adjusted in length to accommodate a different sized reflector 30.

As a result from allowing the upper hat and lower base segments 12 and 16 to be used in a variety of reflector size applications, as opposed to being tied to use with a single sized reflector 30, the modular feed system provides the end user with an upgrade path via leveraging their feed system through different reflector installations, if so desired, as well as providing cost reduction through volume purchasing of the common upper hat and lower base segments 12 and 16 for use in combination with a variety of reflector sizes and mid-section segments 14 of various lengths.

Figure 2:
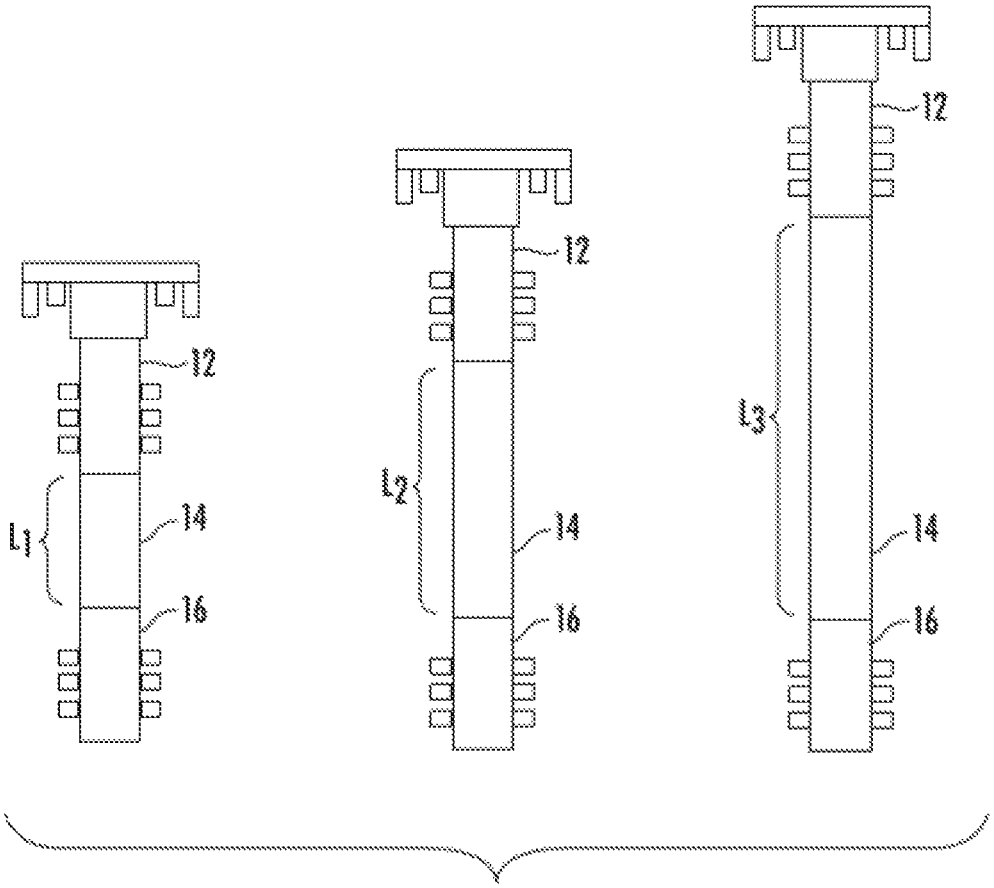
FIG. 2 is a diagram illustrating side elevational views of three embodiments of bayonet feed structures, each having common upper hat and lower base segments connected to a mid-section of varying length.

As discussed above, the modular development of the subject axis symmetric feed system leads to a product family matrix that is primarily distinguished by two distinct variables—(1) band of operation; and (2) the size of the reflector 30. Referring to FIG. 2, the common upper hat and lower base segments 12 and 16 are shown in combination with three mid-section segments 14 of varying length (L1, L2, and L3). Assuming three dissimilarly sized reflectors with X, Ku and Ka bands, a nine-element product matrix is realized.

Figure 3:
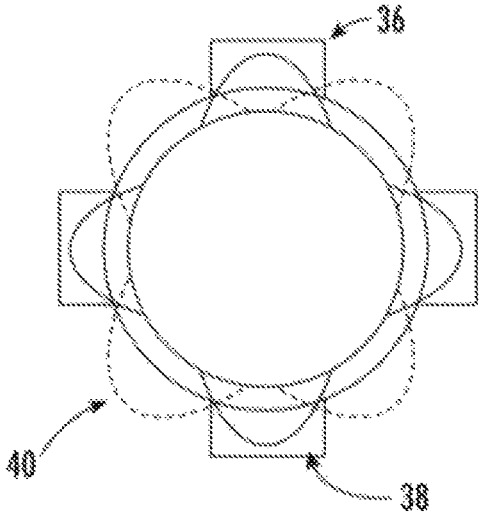
FIG. 3 is a diagram illustrating a top plan view of the lower base segment slot for feed spring entry in the open position.
Figure 4:
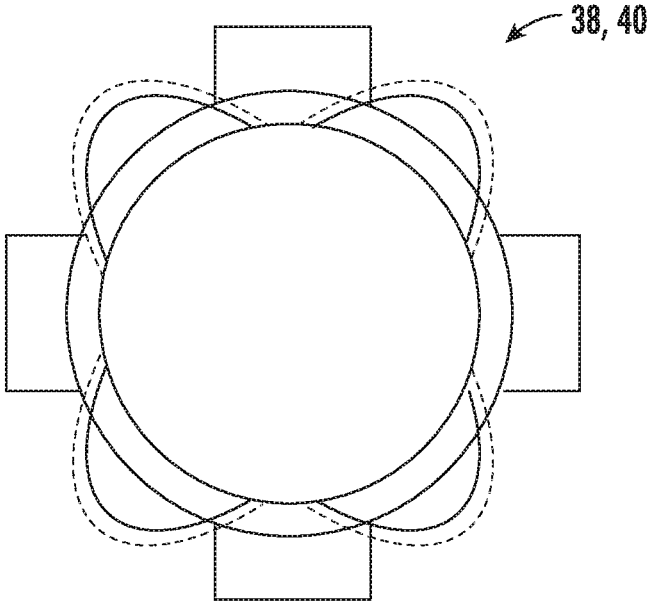
FIG. 4 is a diagram illustrating a top plan view of the lower base segment slot for feed spring entry in the locked position.
Figure 5:
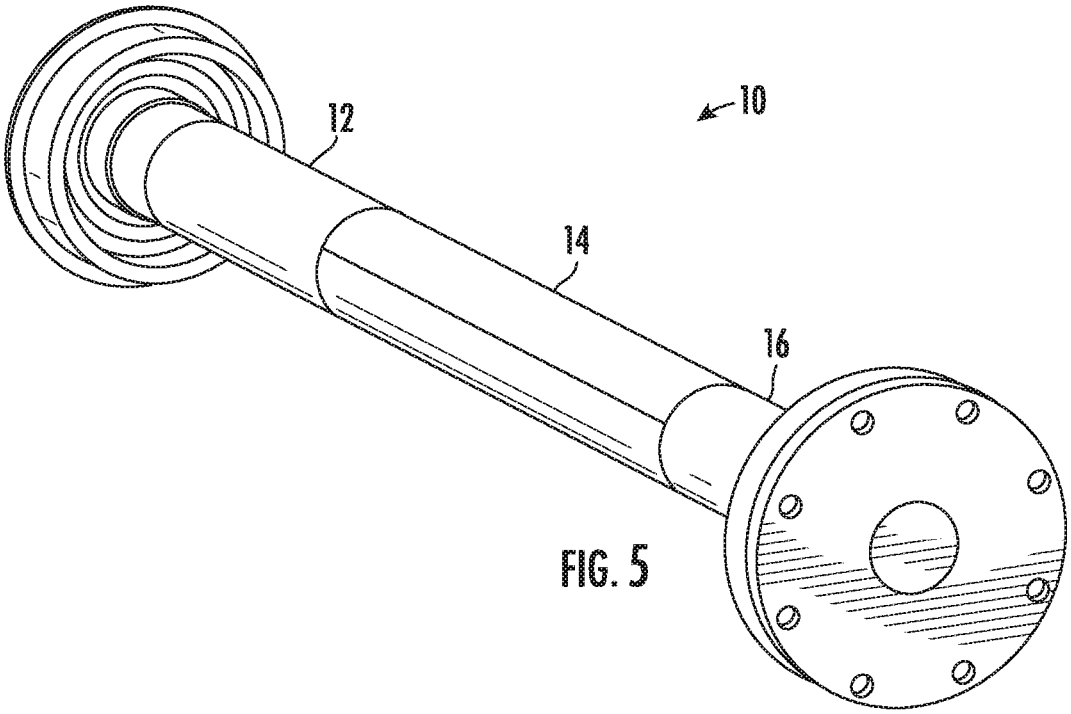
FIG. 5 is an isolated perspective view of the bayonet feed structure.
Figure 6:
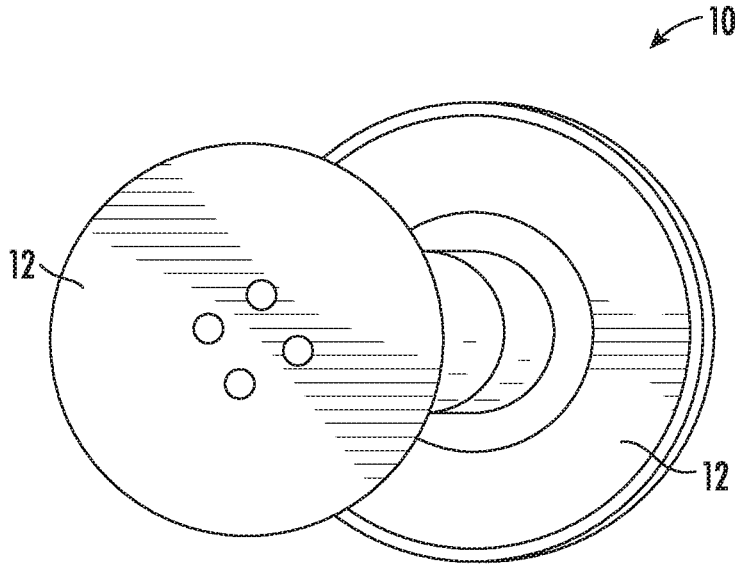
FIG. 6 is an isolated perspective view of the bayonet feed structure.
Figure 7:
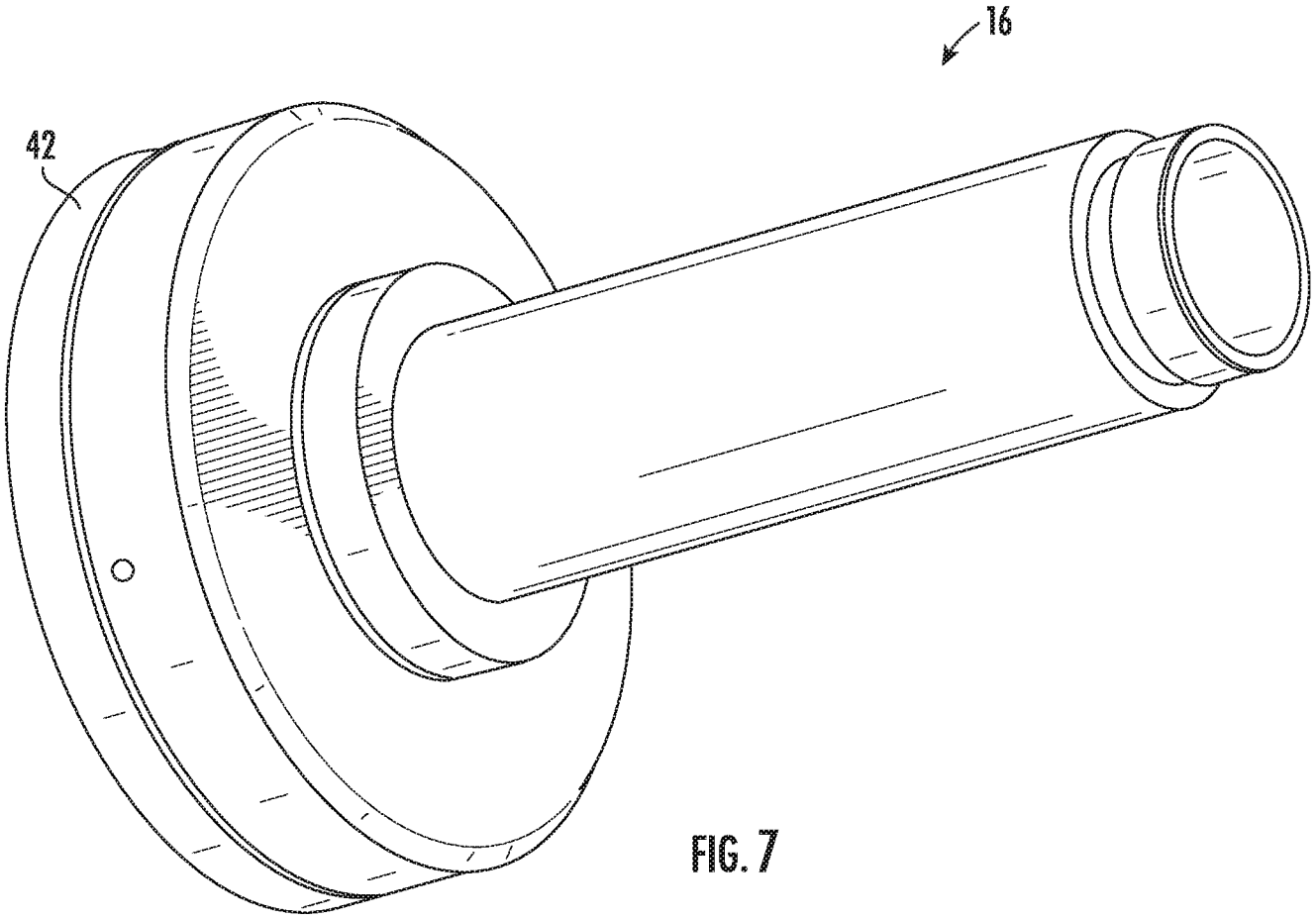
FIG. 7 is an isolated perspective view of the lower base segment of the bayonet feed structure mated to a base.
Figure 8:
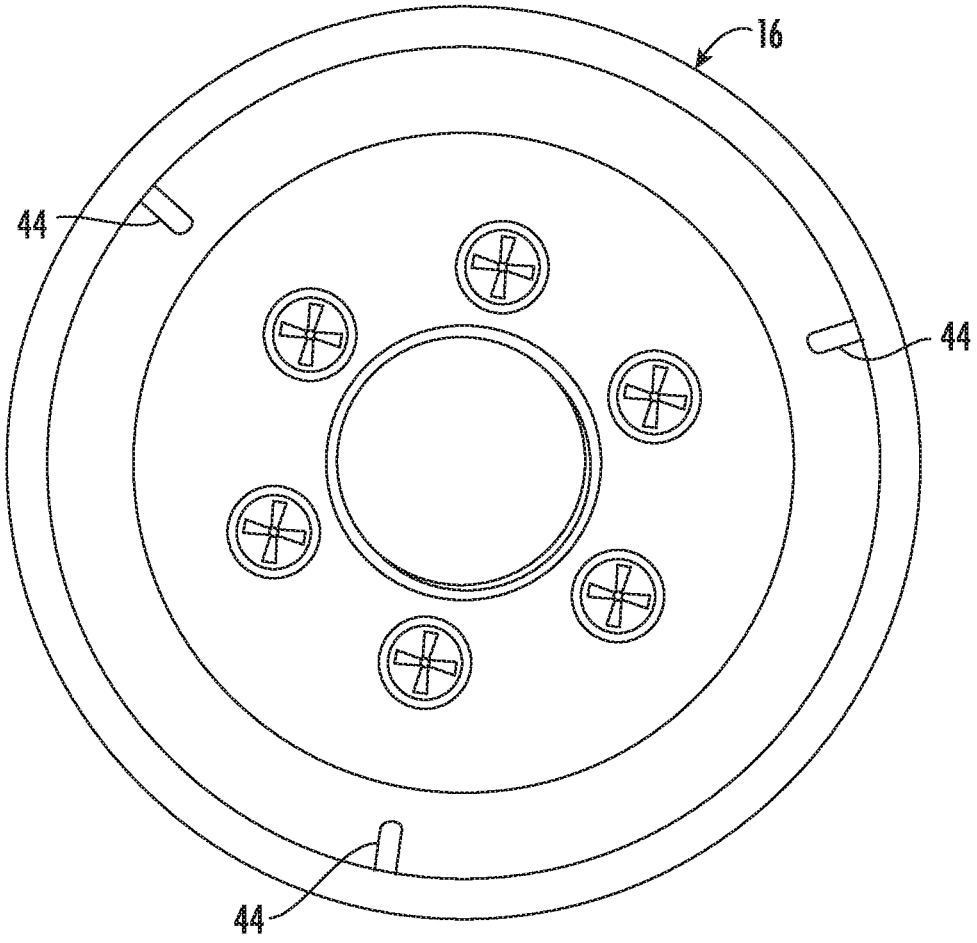
FIG. 8 is a side elevational view of the lower base segment of the bayonet feed structure.
Figure 9:
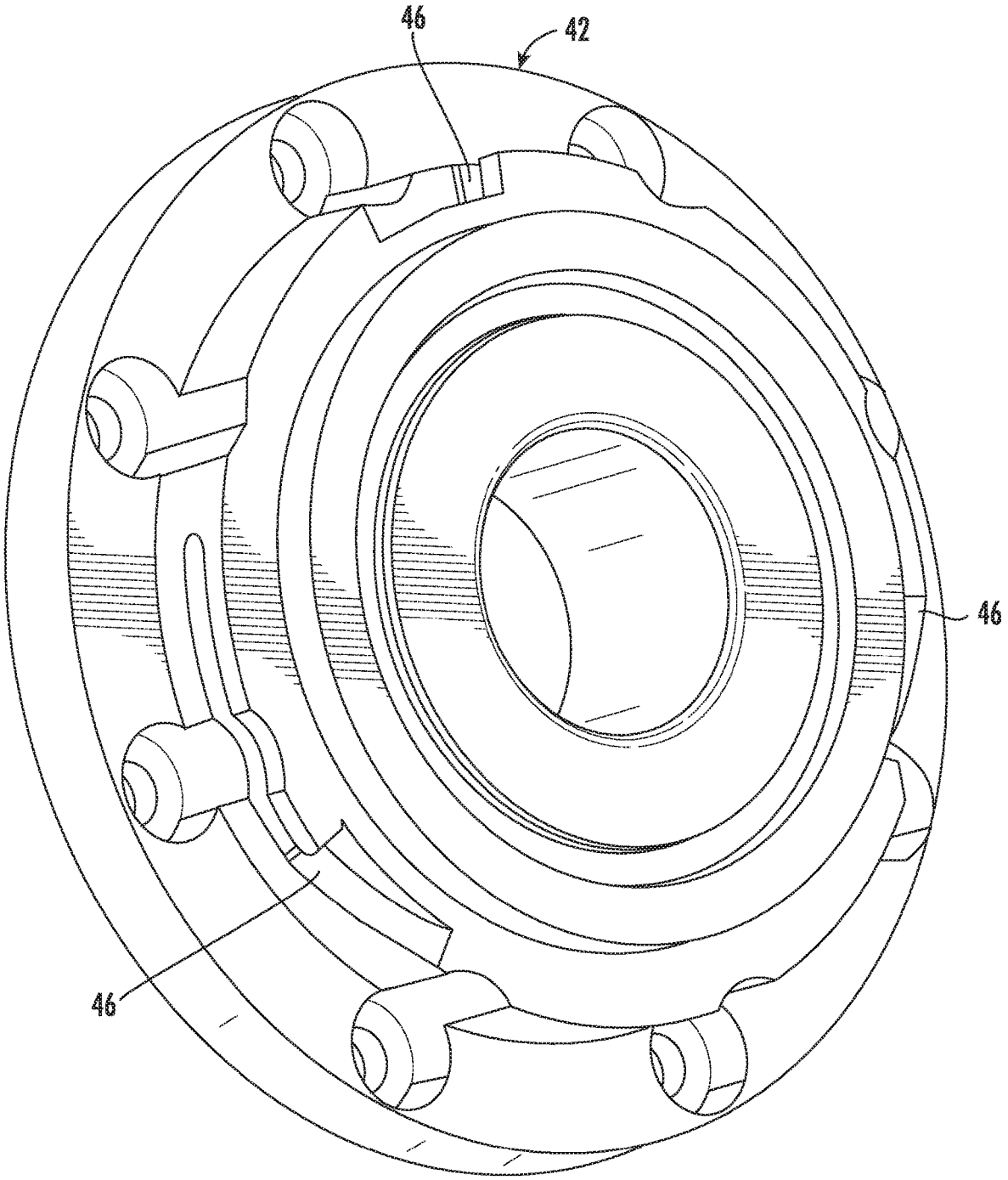
FIG. 9 is an isolated perspective view of the base.

Referring now to FIGS. 3 and 4, a capturing mechanism for rapid and reliable installation of the feed bayonet is provided. Referring specifically to FIG. 3, the mechanical coupling mechanism concept showing a circular base with notches to allow carriage springs to pass through as part of the initial mating of the feed to the base segment. Specifically provided are a base slot 36 for feed spring entry, a carriage spring 38 on the feed, and a spring capture location 40. Referring specifically to FIG. 4, a quarter turn moves the carriage springs into a recessed location that causes an audible "click" for indicating that the feed has locked into position.

Referring now to FIGS. 5-9, one embodiment of the bayonet feed structure 10 is shown. The base 42 includes a plurality of slots 44 for capturing protrusions 46 for mating the bayonet feed structure 10 with the base 42.

Another embodiment of the invention (not pictured) includes two modular components—an upper hat segment and a lower base segment. Each of the upper hat and lower base segments in this embodiment can be of varying configuration for selection based on the required specifications.

While the present invention has been shown and described in accordance with several preferred and practical embodiments, it is recognized that departures from the instant disclosure are contemplated within the spirit and scope of the present invention.

What is claimed is:

1. A modular feed system for axis symmetric reflector antennas, said modular feed system comprising:

an upper hat segment, a mid-section segment and a lower base segment, said upper hat and lower base segments being securable to respective opposing ends of said mid-section segment;

wherein the length of said mid-section segment is selected in order to accommodate application of a particularly sized reflector antenna;

said upper hat segment including a splash plate, a corrugation, a head and a first plurality of rings;

said lower base segment including a second plurality of rings that matches said first plurality of rings; and a mechanical mating mechanism comprising:

at least one base slot for feed spring entry, at least one corresponding carriage spring on the feed, and at least one corresponding recessed spring capture location; and wherein said at least one carriage spring is sized and configured to pass through a corresponding one of said at least one base slots for feed spring entry as part of the initial mating of the feed to the base segment, and selective rotation thereof moves the corresponding one of said at least one carriage springs into a corresponding one of said at least one recessed spring capture locations and causing a mechanically audible sound for indicating that the feed has locked into position.

2. The modular feed system as recited in claim 1 wherein said at least one carriage spring must be selectively rotated 90-degrees after said at least one carriage spring passes through the corresponding one of said at least one base slots before said at least one carriage springs moves into the corresponding one of said at least one recessed spring capture locations.

3. A modular feed system for axis symmetric reflector antennas, said modular feed system comprising:

an upper hat segment, a mid-section segment and a lower base segment, said upper hat and lower base segments being securable to respective opposing ends of said mid-section segment;

wherein the length of said mid-section segment is selected in order to provide feeding function across a particular frequency band;

said upper hat segment including a splash plate, a corrugation, a head and a first plurality of rings;

said lower base segment including a second plurality of rings that matches said first plurality of rings; and a mechanical mating mechanism comprising:

at least one base slot for feed spring entry, at least one corresponding carriage spring on the feed, and at least one corresponding recessed spring capture location; and wherein said at least one carriage spring is sized and configured to pass through a corresponding one of said at least one base slots for feed spring entry as part of the initial mating of the feed to the base segment, and selective rotation thereof moves the corresponding one of said at least one carriage springs into a corresponding one of said at least one recessed spring capture locations and causing a mechanically audible sound for indicating that the feed has locked into position.

4. The modular feed system as recited in claim 3 wherein said at least one carriage spring must be selectively rotated 90-degrees after said at least one carriage spring passes through the corresponding one of said at least one base slots before said at least one carriage springs moves into the corresponding one of said at least one recessed spring capture locations.

5. A modular feed system for axis symmetric reflector antennas, said modular feed system comprising:

an upper hat segment, a mid-section segment and a lower base segment, said upper hat and lower base segments being securable to respective opposing ends of said mid-section segment;

wherein the length of said mid-section segment is selected in order to provide feeding function across a particular frequency band;

said upper hat segment including a splash plate, a corrugation, a head and a first plurality of rings;

said lower base segment including a second plurality of rings that matches said first plurality of rings; and a mechanical mating mechanism comprising at least one base slot and at least one corresponding carriage spring on the feed, wherein said at least one carriage spring is sized and configured to pass through a corresponding one of said at least one base slots for feed spring entry as part of the initial mating of the feed to the base segment, and selective rotation thereof moves the corresponding one of said at least one carriage springs into a corresponding one of said at least one recessed spring capture locations to lock the feed into position.

6. The modular feed system as recited in claim 5 wherein said at least one carriage spring must be selectively rotated 90-degrees after said at least one carriage spring passes through the corresponding one of said at least one base slots before said at least one carriage springs moves into the corresponding one of said at least one recessed spring capture locations.

* * * * *